US006503877B2

(12) United States Patent
Grande et al.

(10) Patent No.: US 6,503,877 B2
(45) **Date of Patent: *Jan. 7, 2003**

(54) STABLE COLORED THICKENED BLEACHING COMPOSITIONS

(75) Inventors: Giovanni Grande, Rome (IT); Oreste Todini, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/142,086

(22) Filed: May 9, 2002

(65) Prior Publication Data

US 2002/0183232 A1 Dec. 5, 2002

Related U.S. Application Data

(63) Continuation of application No. 09/600,385, filed as application No. PCT/US98/27276 on Dec. 22, 1998, now Pat. No. 6,448,215.

(30) Foreign Application Priority Data

Jan. 16, 1998 (EP) ..... 98870007

(51) Int. Cl.[7] ..... C11D 3/395
(52) U.S. Cl. ..... 510/380; 510/419
(58) Field of Search ..... 510/419, 379, 510/380, 373

(56) References Cited

U.S. PATENT DOCUMENTS 4,623,476 A * 11/1986 Nayar et al. ..... 252/94
4,917,814 A * 4/1990 MacIntyre et al. ..... 252/102
5,034,150 A * 7/1991 Smith ..... 252/187.25

* cited by examiner

*Primary Examiner*—Yogendra N. Gupta
*Assistant Examiner*—John M Petruncio
(74) *Attorney, Agent, or Firm*—James F. McBride; Kim W. Zarby; Steven W. Miller

(57) ABSTRACT

The present invention relates to liquid colored thickened hypohalite bleaching-containing compositions having a viscosity of 10 cps to 2000 cps and comprising a hypohalite bleach, an alkyl (alkoxy)n sulphate, wherein n is from 2 to 4, optionally a co-surfactant, and a pigment selected from the group consisting of Ultramarine Blue and its equivalents, chlorinated indanthrone and its equivalents, cobalt aluminate blue and mixtures thereof.

20 Claims, No Drawings

STABLE COLORED THICKENED BLEACHING COMPOSITIONS

CROSS-REFERENCE TO RELATED APPLICATIONS

This application claims priority under 35 U.S.C. § 120 to U.S. Application Ser. No. 09/600,385, filed Jul. 14, 2000, which is an entry into the U.S. National Stage under 35 U.S.C. § 371 of PCT International Application Ser. No. PCT/US98/27276, filed Dec. 22,1998, now U.S. Pat. No. 6,448,215 which claims priority under PCT Article 8 and 35 U.S.C. § 119 to EPO 98870007.6, filed Jan. 16, 1998.

FIELD OF THE INVENTION

The present invention relates to liquid coloured thickened bleaching compositions, in particular to liquid coloured thickened hypochlorite bleaching compositions, which can be used to bleach various surfaces including but not limited to, hard-surfaces like walls, tiles, floors, glass, bathrooms surfaces, kitchen surfaces, toilet bowls, dishes as well as fabrics, clothes, carpets and the like.

BACKGROUND OF THE INVENTION

Thickened bleaching compositions are well-known in the art. Amongst the different thickened bleaching compositions available, those relying on bleaching by hypohalite bleaches such as hypochlorite are often preferred, mainly for performance reasons.

Preferably viscosity will be build up by a so called 'self thickening surfactant or surfactant system' as opposed to using a thickener for that specific purpose. Indeed, thickeners, such as gums, polymers have at least one drawback that they affect the formula cost, while providing only one benefit, which is thickening. They do not participate to the actual cleaning of the surface and therefore represent "inert" materials.

Thus, it is desirable to formulate liquid thickened bleaching compositions based on hypohalite bleach, especially liquid coloured thickened bleaching compositions, with the help of a viscosifying surfactant which on top of its viscosifying properties also delivers good cleaning performance, i.e. good stain removal performance on a variety of stains including greasy stains and/or enzymatic stains and the like.

There is a further need to liquid coloured thickened bleaching compositions based on hypohalite bleach and a viscosifying surfactant that are chemically and physically stable upon ageing of the compositions, i.e., for prolonged periods of storage after their manufacturing. Indeed, it is desirable to provide liquid coloured thickened hypohalite bleach-containing compositions which have stable coloration upon prolonged periods of storage, i.e., which retain an homogeneous coloration during prolonged periods of storage.

It is therefore an object of the invention to provide a stable liquid coloured thickened hypohalite bleach-containing composition comprising a viscosifying surfactant, said composition being physically and chemically stable upon ageing of the composition while delivering excellent stain removal performance on a variety of stains.

The Applicant has thus now surprisingly found that this problem is solved by formulating a liquid thickened bleaching composition having a viscosity of 10 cps to 2000 cps, when measured with a carri-med CSL2-100® rheometer at the following viscosity parameters: angle 1°58', gap 60 $\mu$m, diameter 4.0 cm, inner 63.60 dyne*cm*s$^2$, temperature of 25° C. and a shear rate of 30 sec $^{-1}$, said composition comprising a hypohalite bleach, an alkyl (alkoxy)$_{2-4}$ sulphate, optionally a co-surfactant and a pigment selected from the group consisting of Ultramarine Blue ($Na_7Al_6Si_6O_{24}S_2$) and its equivalents, chlorinated indanthrone and its equivalents, cobalt aluminate blue and mixtures thereof. Indeed, it has been found that the addition of such a pigment in a liquid self-thickened hypohalite bleach-containing composition according to the present invention comprising a hypohalite bleach, an alkyl (alkoxy)$_{2-4}$ sulphate, and optionally a co-surfactant, does not negatively affect the chemical and physical stability of the composition upon ageing, i.e., upon prolonged periods of storage after its manufacturing. In other words, the present invention provides liquid coloured thickened hypohalite bleach-containing compositions with enhanced rheological properties which are capable of stably suspending the pigments.

In a preferred embodiment, the compositions of the present invention further comprise a stabilising agent preferably a radical scavenger, a chelating agent or a mixture thereof. Indeed it has been found that the addition of such a stabilising agent, preferably a radical scavenger alone or together with a chelating agent, in a liquid coloured thickened bleaching composition comprising a hypohalite bleach, an alkyl (alkoxy)$_{2-4}$ sulphate, optionally a co-surfactant and the pigment, improves the rheological stability of this composition upon ageing, i.e. upon prolonged periods of storage after its manufacturing, as compared to the Theological stability of the same composition without any such stabilising agent, upon ageing of the composition. In other words, adding such a stabilising agent reduces or even prevents lowering of the viscosity of the compositions upon prolonged periods of storage which could otherwise happen in absence of this stabilizing agent. Indeed in absence of such a stabilizing agent the viscosifying surfactant may be decomposed by the hypohalite bleach present and thus may lose its viscosifying potential. Additionally the presence of such a stabilizing agent in the preferred coloured thickened bleaching compositions of the present invention further contributes to the benefits of the compositions herein, i.e., to provide chemical and physical stable coloured compositions that retain their colour upon prolonged periods of storage.

Another advantage of the compositions of the present invention is that they deliver effective bleaching performance, more particularly effective whiteness performance when used in any laundry application, as well as effective stain removal performance on various stains including greasy stains like lipstick, make up, sebum, oil (mineral and vegetable), mayonnaise, eggs and the like and/or enzymatic stains like grass, cocoa, blood and the like, even upon ageing of the composition. In a preferred embodiment wherein the liquid coloured thickened compositions of the present invention further comprise a stabilising agent, the presence of such a stabilizing agent further contributes to deliver effective bleaching performance and/or effective stain removal performance on various stains upon ageing of the compositions.

Advantageously the compositions of the invention are suitable for the bleaching of different types of surfaces including hard-surfaces like floors, walls, tills, glass, kitchen surfaces, bathrooms surfaces, toilet bowls and/or dishes and the like as well as fabrics. More particularly, the compositions of the present invention are suitable for bleaching any type of fabrics including natural fabrics (e.g., fabrics made of cotton, viscose, linen, silk and wool), synthetic fabrics such as those made of polymeric fibers of synthetic origin as well as those made of both natural and synthetic fibers.

Indeed, the compositions of the present invention may be used on synthetic fibers despite a standing prejudice against the use of hypohalite bleaches, especially hypochlorite bleaches, on synthetic fibers, as evidenced by warning on labels of commercially available hypochlorite bleaches and clothes. Advantageously the compositions of the present invention are not only safe to the fabrics perse bleached therewith but also to the fabrics colours.

A further advantage of the liquid bleaching compositions of the present invention is that said bleaching compositions are suitable for various laundry bleaching applications both when used in diluted conditions, e.g. as a detergent additive or a fully formulated laundry detergent composition, and when used in neat condition, e.g. as a liquid pretreater (spotter).

SUMMARY OF THE INVENTION

The present invention is a liquid coloured thickened bleaching composition having a viscosity of from 10 cps to 2000 cps, when measured with a Carri-med CSL2-100® rheometer, at the following viscosity parameters: angle 1°58', gap 60 $\mu$m, diameter 4.0 cm, inner 63.60 dyne*cm*s$^2$, temperature of 25° C. and a shear rate of 30 sec $^{-1}$ and comprising a hypohalite bleach, an alkyl (alkoxy)$_n$ sulphate, wherein n is from 2 to 4 optionally a co-surfactant, and a pigment selected from the group consisting of Ultramarine Blue ($Na_7Al_6Si_6O_{24}S_2$) and its equivalents, chlorinated indanthrone and its equivalents, cobalt aluminate blue and mixtures thereof.

Yet the present invention also encompasses a process of bleaching a surface (including fabrics, hard-surfaces and/or dishes) where said surface is contacted with a liquid coloured bleaching composition according to the present invention, in its neat or diluted form.

DETAILED DESCRIPTION OF THE INVENTION

Liquid Bleaching Compositions

The compositions according to the present invention are in liquid form.

Preferably, the compositions of the invention are in liquid aqueous form. More preferably, they comprise water in an amount of from 60% to 98% by weight, more preferably of from 80% to 97% and most preferably of from 85% to 97% by weight of the total aqueous liquid bleaching composition.

The compositions according to the present invention are thickened compositions, thus they have a viscosity of from 10 cps to 2000 cps, when measured with a Carri-med CSL2-100® rheometer, at the following viscosity parameters : angle 1°58', gap 60 $\mu$m, diameter 4.0 cm, inner 63.60 dyne*CM*s$^2$, temperature of 25° C. and a shear rate of 30 sec$^{-1,}$ preferably from 25 cps to 1500 cps, and more preferably from 50 cps to 1200 cps.

Hypohalite Bleaches

An essential component of the invention is a hypohalite bleach. Hypohalite bleaches may be provided by a variety of sources, including bleaches that are oxidative bleaches and subsequently lead to the formation of positive halide ions as well as bleaches that are organic based sources of halides such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For the liquid compositions herein, the preferred hypohalite bleaches among the above described are the alkali metal and/or alkaline earth metal hypochlorites selected from the group consisting of sodium, potassium, magnesium, lithium and calcium hypochlorites, and mixtures thereof, more preferably the alkali metal sodium hypochlorite.

Preferably, the liquid compositions according to the present invention comprise said hypohalite bleach or mixture thereof such that the content of active halide in the composition is from 0.1% to 20% by weight, more preferably from 0.25% to 8% by weight, most preferably from 0.5% to 6% by weight of the composition.

The alkyl (alkoxy)$_{2-4}$ sulphates

An essential component of the invention is an alkyl (alkoxy)$_n$ sulphate, wherein n is from 2 to 4, or a mixture thereof.

Suitable alkyl (alkoxy)$_{2-4}$ sulphate surfactants for use herein are water-soluble salts or acids of the formula:

$RO(A)_nSO_3M$, wherein

R is a substituted or unsubstituted, linear or branched $C_4$–$C_{24}$ alkyl, preferably a $C_8$–$C_{20}$ linear or branched alkyl, more preferably $C_8$–$C_{18}$ linear or branched alkyl, most preferably $C_{I0}$–$C_{16}$ linear or branched alkyl, A is an ethoxy or propoxy unit, n is from 2 to 4, preferably 2 or 3 and more preferably 3, and M is H or a cation which can be, for example, a metal cation (e.g., sodium, potassium, lithium, calcium, magnesium, etc.), ammonium or substituted-ammonium cation.

Alkyl (ethoxy)2 sulphates and alkyl (ethoxy)3 sulphates are preferred herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Sodium C12/C14 E3 sulphate may be for example commercially available from Albright & Wilson under the name EMPICOL ESC3®. Sodium C12/C14 E2 sulphate may be for example commercially available from Rhone Poulenc under the name Rhodapex ES-2®.

Preferably, the liquid compositions according to the present invention comprise said alkyl (alkoxy)$_{2-4}$ sulphate in amount of from 0.1% to 20% by weight, more preferably from 0.5% to 15%, even more preferably from 2% to 10% by weight, most preferably from 3% to 8% by weight of the composition.

The presence of such an alkyl (alkoxy)$_{2-4}$ sulphate, preferably an alkyl (ethoxy)2-4 sulphate, provides viscosity to the liquid bleaching compositions of the present invention while helping to stably suspend the pigment. Indeed, the presence of such an alkyl (alkoxy)$_{2-4}$ sulphate in the liquid coloured bleaching compositions of the present invention reduce or even prevents the sedimentation of the pigment, i.e., the settlement phenomenon and hence allows the formulation of coloured thickened bleaching compositions being physically stable upon prolonged periods of storage after their manufacturing.

In other words, the present compositions offer improved viscosity for hypohalite bleach-containing compositions while at the same time providing a commercially acceptable pigmented compositions with excellent colour stability.

By "physically stable", it is meant that no visually noticeable pigment settling occurs after 1 month storage at 25° C.

Advantageously, the liquid coloured thickened hypohalite containing compositions provided according to the present invention are chemically stable. By "chemically stable", it is meant that the hypohalite bleaching compositions of the present invention do not undergo more than 25% loss of available chlorine after 5 days of storage at 50° C.±0.5° C., preferably not more than 20%. The % loss of available chlorine may be measured using the method described, for instance, in "Analyses des Eaux et Extraits de Javel" by "La chambre syndicale nationale de L'eau de Javel et des produits connexes", pages 9–10 (1984). Said method consists in measuring the available chlorine in the fresh compositions, i.e. just after they are made, and in the same compositions after 5 days at 50° C.

It has also been found that the presence of such an alkyl $(alkoxy)_{2-4}$ sulphate, preferably an alkyl (ethoxy)2-4 sulphate, allows to deliver excellent stain removal performance on various types of stains including greasy stains and/or enzymatic stains. Moreover, in a laundry application the presence of such an alkyl $(alkoxy)_{2-4}$ sulphate and especially an alkyl $(ethoxy)_{2-4}$ sulphate in the bleaching compositions of the present invention will improve the whiteness to fabrics which are treated with said bleaching compositions.

In other words, the presence of a single material, i.e. an alkyl $(alkoxy)_{2-4}$ sulphate, provides at the same time the viscosity characteristics of the compositions herein and stable colour to the compositions upon prolonged periods of storage while delivering excellent stain removal performance and/or whiteness performance to a fabric treated with the compositions herein comprising the same. Thus another advantage of the present invention is that the compositions herein may be formulated in a cost effective manner.

Optional Co-Surfactants

The liquid compositions of the present invention may further comprise a co-surfactant or a mixture thereof as a desirable optional ingredient to regulate the viscosity of the compositions herein. More particularly, the co-surfactants for use herein have the properties to modify the initial viscosity provided by the presence of the alkyl $(alkoxy)_{2-4}$ sulphate in the compositions of the present invention, i.e. to lower or higher the viscosity provided by the sole presence of such alkyl $(alkoxy)_{2-4}$ sulphate as a viscosifying surfactant, in the compositions herein. In other words, such a co-surfactant will be chosen depending on the initial viscosity desired for the compositions of the present invention.

Typically, the compositions according to the present invention comprise said co-surfactant in amounts of from 0.01% to 10% by weight of the total composition, preferably of from 0.1% to 5% and more preferably of from 0.1% to 2.5%.

Suitable co-surfactants for use herein are typically selected from the group consisting of alkyl sulphates, alkyl aryl sulphonates, alkyl alkoxy sulphates with 1 or more than 4 alkoxylated units, zwitterionic surfactants like betaine surfactants, cationic surfactants like alkyl trimethylammonium halogenides and mixture thereof.

Suitable alkyl sulphates for use in the compositions herein include water-soluble salts or acids of the formula $ROSO_3M$ wherein R preferably is a $C_4$–$C_{24}$ hydrocarbyl, preferably linear or branched alkyl having a $C_6$–$C_{20}$ alkyl component, more preferably a $C_6$–$C_{18}$ linear or branched alkyl, most preferably a $C_6$–$C_{16}$ linear or branched alkyl and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like).

Other alkyl alkoxy sulphates for use herein are water-soluble salts or acids of the formula $RO(A)_mSO_3M$ wherein R is a substituted or unsubstituted $C_4$–$C_{24}$ linear or branched alkyl group having a $C_4$–$C_{24}$ alkyl component, preferably a $C_8$–$C_{20}$ linear or branched alkyl, more preferably $C_{10}$–$C_{18}$ linear or branched alkyl, most preferably $C_{10}$–$C_{16}$ linear or branched alkyl, A is an ethoxy or propoxy unit, m is 1 or above 4, typically between about 5 and about 30, more preferably between about 5 and about 15, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate(8) sulfate, $C_{12}$–$C_{18}E(6)$ sulfate, wherein the counterion is conveniently selected from sodium and potassium.

Suitable alkyl aryl sulphonates for use herein include water-soluble salts or acids of the formula $RSO_3M$ wherein R is an aryl, preferably a benzyl, substituted by a $C_4$–$C_{20}$ linear or branched saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like).

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants to be used herein is:

$$R_1\text{-}N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$-C(O)-NH-$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH2)_n$ wherein n is an integer from I to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

Suitable cationic surfactants are alkyl trimethylammonium halogenides and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of $-CH_2CH_2-$, $-CH_2CH(CH_3)-$, $-CH_2CH_2CH_2-$, and mixtures thereof; each $R^4$ is selected from the group consisting of $C_1$–$C_4$ alkyl, benzyl ring structures formed by joining the two $R^4$ groups, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion. Most preferred cationics are linear or branched C8–C20 trimethyl ammonium chlorides.

Pigments

Pigment is another essential component for the coloured thickened compositions of the present invention.

Suitable pigments for use herein are selected from the group consisting of Ultramarine Blue and its equivalents, chlorinated indanthrone and its equivalents, cobalt aluminate blue and mixtures thereof.

A preferred pigment used in this invention is Ultramarine Blue. It is sold as "C.I. Pigment Blue 29; C.I. 77007". It is a blue pigment occurring naturally as the mineral lapis lazulli It is made by igniting a mixture of kaolin, $Na_2CO_3$ (or $Na_2SO_4$), S and carbon. The resulting product is believed to have the formula $Na_7Al_6Si_8O_{24}S_2$. It is insoluble in water and readily decomposed by acids, even carbonic acid, with liberation of $H_2S$.

"It is used as a pigment in calico printing, wallpaper, mottled soap; bluing in laundry use; for coloring tiles, cement, rubber, but is now largely replaced by coal tar dyes." The Merck Index, $9^{th}$ Ed. Ultramarine Blue is available from Whittaker, Clark & Daniels, Inc. Grade 5017 has a particle size range of 0.2–3.0 microns and Grade 5151 has a particular size range of 0.3–1.3 microns.

Another preferred pigment is C.I. 69825 and is known under the names of C.I. Vat Blue C.I. Pigment Blue 64. They have the following chemical formula:

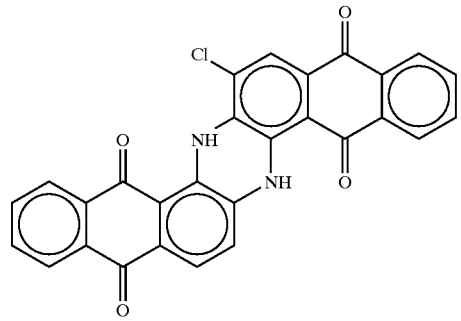

This C.I. 69825 pigment is available from Crompton & Knowles Corporation under the name Intravat Blue®.

The pigment or a mixture thereof is present in the compositions of the present invention at levels of from 0.0001% to 0.5%, preferably from 0.0002% to 0.05%, more preferably from 0.003% to 0.02% and most preferably from 0.006% to 0.015%.

The preferred pigment for use in the coloured thickened bleaching compositions herein is Ultramarine blue. Although the pigments and especially Ultramarine blue are inert to hypochlorite oxidation and do not catalyse decomposition of hypochlorite bleach, they are insoluble and require suspension in the hypochlorite bleach composition. Such suspension cannot be achieved merely by dispensing particle of Ultramarine Blue in hypochlorite composition, because the pigment has density of 2.35 and settles out even when it is of very fine particle size. The viscosifying surfactants employed in the compositions of the present invention, i.e. the alkyl alkoxy sulphate and optionally a co-surfactant, provide excellent suspension for the pigment and especially Ultramarine blue pigment particles.

pH

The pH of the liquid compositions according to the present invention, as is, is typically from 10 to 14, more preferably from 12 to 14 measured at 25° C. The liquid compositions of the invention have a pH of from 7.5 to 13, preferably from 8 to 12, more preferably from 8.5 to 11.5, when diluted into 1 to 500 times its weight of water. It is in this alkaline range that the optimum stability and performance of the hypohalite as well as fabric whiteness and/or safety are obtained. The pH range is suitably provided by the hypohalite bleach mentioned hereinbefore, which are alkalis and optionally by the pH buffering component if present. However, in addition to these components, a strong source of alkalinity may also optionally be used.

Suitable sources of alkalinity are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide. Typical levels of such caustic alkalis, when present, are of from 0.1% to 1.5% by weight, preferably from 0.5% to 1.5% by weight of the composition.

The composition according to the invention may comprise other optional components such as pH buffering components, stabilizing agents, other bleach-stable surfactants, builders, thickening agents, polymers, dyes, solvents, perfumes, brighteners, and mixtures thereof.

Optional pH Buffering Components

The compositions according to the present invention may optionally comprise a pH buffering component or mixture thereof. Such a pH buffering component is a highly preferred optional ingredient for the compositions of the invention.

The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. The preferred alkali metal salts for use herein are sodium and potassium.

Suitable boron salts or mixtures thereof for use herein include alkali metal salts of borates and alkyl borates and mixtures thereof. Examples of boron salts include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Particularly preferred boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g calcium carbonate resulting in an amount of up to 0.4% by weight of by-product within the hypohalite composition. However, at such amount, the by-product will not have the buffering action defined above.

Liquid bleaching compositions herein preferably contain an amount of pH buffering component of from 0.5% to 9% by weight, preferably from 0.5% to 5% by weight, and more preferably in an amount of from 0.6% to 3% by weight of the composition.

The presence of such a pH buffering component in the bleaching compositions of the present invention contributes to the effective whiteness performance of said compositions as well as to the fabric safety of these compositions.

Optional Stabilising Agents

The compositions according to the present invention may optionally comprise a stabilising agent or a mixture thereof. Such a stabilising agent is a highly preferred optional ingredient for the compositions of the invention. Particularly suitable stabilising agents for use herein include a radical scavenger, a chelating agent or a mixture thereof. Naturally, for the purpose of the invention, the stabilizing agents have to be stable to the hypohalite bleach.

Highly preferred in the liquid bleaching compositions of the present invention as the stabilising agent is a radical scavenger or a mixture thereof alone, or together with a chelating agent or a mixture thereof.

Suitable radical scavengers for use herein include aromatic radical scavengers comprising an unsaturated ring system of from 3 to 20 carbon atoms, preferably of from 3 to 18 and more preferably of from 5 to 14 and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Particularly suitable radical scavengers (aryl carboxylates, aryl sulphonate and derivatives thereof) for use in the present invention have one of the following formulas:

(a)

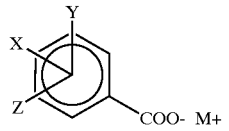

(b)

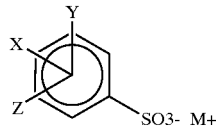

c)

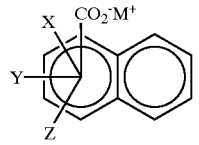

d)

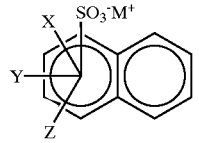

wherein each X, Y, and Z are -H, -COO-$M^+$, -Cl, -Br, -$SO_3$-$M^+$, -$NO_2$, -$OCH_3$, or a $C_1$ to $C_{10}$ primary and secondary alkyl groups and M is H or an alkali metal, or mixtures thereof. Examples of these components include pyromellitic acid, i.e. where X, Y and Z are -COO-$H^+$; hemimellitic acid, trimellitic acid, i.e. where X and Y are -COO-$H^+$and Z is H. Preferred to be used in the present invention as radical scavengers are phthalic acid; sulfophthalic acid; other mono-substituted phthalic acids; di-substituted benzoic acids; alkyl-, chloro-, bromo-, sulfo-, nitro- and alkoxy- benzoic acids, i.e. where Y and Z are -H and X is a $C_1$ to $C_{10}$ primary and secondary alkyl groups, -Cl, -Br, -$SO_3$-$H^+$, -$NO_2$ or -$OCH_3$ (anisic acid) respectively and substituted sulfonic acids. Highly preferred examples of the radical scavengers useful in the present invention are benzoic acid, toluic acid, 4-toluene sulfonic acid, 3-nitro benzoic acid, 2 n-octyl benzoic acid, 2 n-octyl sulfonic acid, anisic acid or mixtures thereof. Most preferred herein are benzoic acid, methoxy benzoic acid and/or 3-nitrobenzoic acid.

All the radical scavengers described above are the acidic form of the species, i.e.

M is H. It is intended that the present invention also covers the salt derivatives of these species, i.e. M is an alkali metal, preferably sodium or potassium. In fact, since the pH of the compositions of the present invention is in the alkaline range, the radical scavengers of the present invention exist primarily as the ionized salt in the aqueous composition herein. The anhydrous derivatives of certain species described herein above can also be used in the present invention, e.g. pyromellitic dianhydride, phthalic anhydride, sulphthalic anhydride and the like.

Suitable chelating agents for use herein may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents are as following: Phosphonic acid can be condensed in the reaction

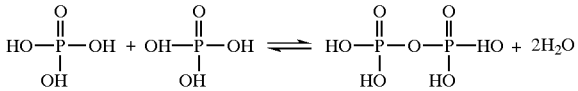

The reaction can be repeated with any of the reactive OH groups, and phosphate ingredients are obtained which can be linear or branched polyphosphates of structure

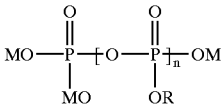

when R is M or

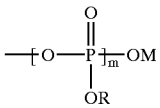

when M is a counterion, preferably alkali metal;

when $0 \leqq n+m<500$ (if n+m=0 then the compound is phosphonic acid)

cyclic polyphosphates (also referred to as metaphosphates), of structure

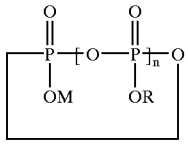

when R is M or

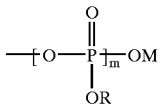

if R is

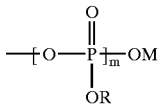

the phosphate compound contains both cycles and branched chain, and can be referred to as an ultraphosphate.)

where M is a counterion, preferably an alkali metal where $0 \leqq n+m<500$

All such phosphate ingredients are suitable for use herein, and preferred are linear phosphate ingredients (i.e. R is M) where n is 1 (pyrophosphate) and n is 2 (tripolyphosphate (STPP)), most preferably where n is 2. The most commonly available form of these phosphate is where M is Sodium.

Phytic acid, which is a chelating agent particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J. T. Baker Co., e.g. as a 40% aqueous solution. It is intended that the present invention covers the acidic form of phytic acid as well as alkali metal salt derivatives thereof, particularly sodium or potassium salts thereof. Sodium phytate is available from Jonas Chemical Co (Brooklyn, N.Y.). In fact since the typical pH of the compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'- disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Particularly preferred chelating agents for use herein are phosphate chelating agents like sodium tripolyphosphate, sodium pyrophosphate, phytic acid, and mixtures thereof.

Typically, the compositions according to the present invention may comprise from 0.01% to 10% by weight of the total composition of a stabilising agent, or mixtures thereof, preferably from 0.01% to 8% by weight, more preferably from 0.1% to 5%, and most preferably from 0.2% to 3%.

It has now been found in the preferred embodiment herein that the addition of a stabilising agent, especially a radical scavenger alone or together with a chelating agent in the compositions herein, increases the rheological stability of the compositions.

By "rheological stability", it is meant herein that the compositions of the present invention do not loose more than 30% initial viscosity after ageing the composition for 10 days at 50° C., preferably not more than 25% and more preferably not more than 20%.

Indeed, it is believed that the radical scavenger react with the free radicals present resulting from the radical decomposition of the hypohalite bleach, and prevent them from reacting/oxidising the alkyl $(alkoxy)_{2-4}$ sulphates. Also the chelating agents present have the tendency to bind metal ion impurities (e.g., copper, iron, manganese and the like) present in the compositions (e.g. as by product of the raw material) and thus prevent them from attacking the hypochlorite bleach thereby limiting the generation of free radicals, that would otherwise be generated in presence of such metal ions impurities. Thus adding the chelating agents on top of the radical scavengers further contribute to deliver excellent rheological stability upon ageing of the compositions.

In a preferred embodiment of the present invention wherein the liquid coloured thickened compositions of the present invention further comprise such a stabilising agent, it has also been found that its addition (especially a radical scavenger alone or together with a chelating agent), in the compositions of the present invention, while increasing the rheological stability of the compositions, further provides improved stain removal performance and/or improved fabric whiteness performance upon ageing of the compositions.

The whitening effect, i.e. the yellowing-prevention effect, upon ageing of the composition can be evaluated by comparing side by side a composition according to the present invention to a reference composition (e.g., a composition according to the present invention comprising a hypohalite bleach an alkyl $(alkoxy)_{2-4}$ sulphate, optionally a cosurfactant, a pigment and a stabilizing agent to a reference composition, e.g., the same composition without the stabilising agent, upon ageing of the compositions (e.g. after that the compositions have undergone prolonged storage time).

The degree of yellowing can be determined by both visual and instrumental grading. Visually, the difference in yellowing between items treated with different compositions can be determined by a team of expert panellists. Instrumentally, the assessment can be determined with the help of Colorimeters such as Ganz Griesser® instruments (e.g., Datacolor® Spectraflash® SF 500, Machbet White-eye® 500) or a ZEISS ELREPHO®) or others which are available for instance from Hunterlab® or Gardner®.

The stain removal performance upon ageing of the composition can be evaluated by comparing the compositions according to the present invention to a reference composition upon ageing of the compositions. The stain removal performance can be determined on different stains like greasy stains and/or enzymatic stains visually.

Advantageously, the presence of the stabilising agents may also contribute to reduce tensile strength loss of fabrics and/or colour damage, especially in a laundry pretreatment application. Fabric safety may be evaluated by different test methods including the degree of polymerisation test method according to UNI (Ente Nazionale Italiano di Unificazione) official method UNI 8282-Determinazione della viscosita intrinseca in soluzione di cuprietilendiammina (CED).

Optional Surfactants

The liquid compositions of the present invention may further comprise another surfactant or a mixture thereof on top of the alkyl $(alkoxy)_{2-4}$ sulphate and optional co-surfactant mentioned herein before. Said other surfactants may be present in the compositions according to the present invention in amounts up to 30% by weight of the total composition, preferably of from 0.1% to 20% and more preferably of from 1% to 10%.

Surfactants for use herein include other anionic surfactants, nonionic surfactants, cationic surfactants, amphoteric surfactants, zwitterionic surfactants, and mixtures thereof as long as they do not affect the viscosity and rheological properties of the compositions according to the present invention. Naturally, for the purpose of the invention, the additional surfactants have to be stable to the hypohalite bleach.

Optional Polymers

An optional component of the compositions herein is a polymer. Polymers, have surprisingly been found to also reduce the yellowing of the fabrics treated therewith, i.e. improve whiteness, as well as to improve fabric safety. Naturally, for the purpose of the invention, the polymer has to be stable to the hypohalite bleach.

Suitable polymers for use are polymers comprising monomeric units selected from the group consisting of unsaturated carboxylic acids, polycarboxylic acids, sulphonic acids, phosphonic acids and mixtures thereof. Co-polymerisation of the above monomeric units among them or with other co-monomers such as styrenesulfonic acid is also suitable.

Preferred examples of such polymers are the polymers and co-polymers of monomeric units selected from the group consisting of acrylic acid, maleic acid, vinylsulphonic acid and mixtures thereof. Also suitable for use herein are the above mentioned polymers and co-polymers which are modified in order to contain other functional groups such as aminophosphonic and/or phosphonic units. More preferred polymers are selected from the group consisting of polyacrylate polymers, co-polymers of acrylic and maleic acid, co-polymers of styrene sulphonic acid and maleic acid, and mixtures thereof, preferably modified with aminophosphonic and/or phosphonic groups.

The molecular weight for these polymers and co-polymers is preferably below 100,000, most preferably between 500 and 50,000. Most suitable polymers and co-polymers for use herein will be soluble in an amount up to 0.1% by weight, in an aqueous composition comprising 5% by weight of sodium hypochlorite with its pH adjusted to 13 with sodium hydroxide.

Commercially available such polymers, suitable for use herein, are the polyacrylate polymers sold under the tradename Good-Rite® from BF Goodrich, Acrysol® from Rohm & Haas, Sokalan® from BASF, Norasol® from Norso Haas. Also suitable for use herein are the co-polymers of styrene sulphonic acid and maleic acid, commercially available under the tradename Versaflex® from National Starch such as Versaflex 157, as well as Acumer® terpolymers from Rohm and Haas, in particular Acumer® 3100. Preferred commercially available polymers are the polyacrylate polymers, especially the Norasol® polyacrylate polymers and more preferred are the polyacrylate polymer Norasols® 410N (MW 10,000) and the polyacrylate polymer modified with phosphonic groups Norasol® 440N (MW 4000) and its corresponding acid form Norasol® QR 784 (MW 4000).

A preferred polymer for use herein is a polyacrylate polymer modified with phosphonic groups commercially available under the tradename Norasol® 440N (MW 4000) and its corresponding acid form Norasol® QR 784 (MW 4000) from Norso-Haas.

Mixtures of polymers as herein described may also be used in the present invention.

Polymers herein are preferably present in low amounts, i.e. in amounts of up to 10% by weight, preferably up to 1%, more preferably from 0.001% to 0.5% by weight, most preferably from 0.005% to 0.2% by weight of the liquid composition.

Optional Brighteners

The compositions according to the present invention may also comprise a brightener or a mixture thereof as an optional ingredient. Naturally, for the purpose of the invention, the brightener has to be stable to the hypohalite bleach. The brighteners may be desired herein to further enhance the whiteness performance of the compositions herein.

Brighteners are compounds which have the ability to fluorescent by absorbing ultraviolet wave-lengths of light and re-emitting visible light. Brighteners, also referred to as fluorescent whitening agent (FWA), have been extensively described in the art, see for instance EP-A-0 265 041, EP-A-0 322 564, EP-A-0 317 979 or "Fluorescent whitening agents" by A. K. Sarkar, published by MERROW, especially page 71–72.

Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof.

Examples of optical brighteners which are useful in the present compositions are those identified in U.S. Pat. No. 4,790,856. These brighteners include the PHORWHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins.

Specific examples of brighteners useful herein include 4-methyl-7-diethyl- amino coumarin; 1,2-bis(-benzimidazol-2-yl)ethylene; 1,3-diphenyl-pyrazolines; 2,5-bis(benzoxazol-2-yl)thiophene; 2-styryl-naptho-[1,2-d] oxazole; 2-(stilbene-4-yl)-2H-naphtho[1,2-d]triazole, 3-phenyl-7-(isoindolinyl) coumarin; 3-methyl-7-(isoindolinyl) coumarin; 3-chloro-7-(isoindolinyl) coumarin; 4-(isoindolinyl)-4'-methylstilbene; 4-(isoindolinyl)-4'-methoxystilbene; sodium 4-(isoindolinyl)4'-stilbenesulfonate; 4-(isoindolinyl)-4'-phenylstilbene; 4-(isoindolinyl)-3-methoxy-4'-methylstilbene; 4-(2-chloroisoindolinyl)4'-(2-methylisoindolinyl)-2,2'-stilbenedisosulfonic acid; disodium 4,4'-diisoindolinyl-2,2'-stilbene disulfonate; 4,4'-diisoindolinyl-2,2'-stilbenedisulfonamide; disodium 4,4'-(7,8-dichloro-1-isoindolinyl)2,2-stilbenedisulfonate; disodium 4,4'-(7-chloro-1-isoindolinyl)2,2-stilbenedisulfonate; disodium 4,4'-(6-lsopropoxy-1 -isoindolinyl)2,2-stilbenedisulfonate; disodium 4,4'-(7,8-diisopropyl- 1 -isoindolinyl)2,2-stilbenedisulfonate; disodium 4,4'-(7-butoxy-1-isoindolinyl) 2,2-stilbenedisulfonate; disodium 4,4'-(6-trifluoromethyl-1-isoindolinyl)2,2-stilbenedisulfonate; disodium 4,4'-[6-(1,4,7-trioxanonyl)-1-isoindolinyl)]2,2-stilbenedisulfonate; disodium 4,4'-(7-methoxymethyl-1-isoindolinyl)2,2-stilbenedisulfonate; disodium 4,4'-(6-phenyl-1-isoindolinyl) 2,2-stilbenedisulfonate; disodium 4,4'-(6-naphthyl-1-isoindolinyl)2,2-stilbenedisulfonate; disodium 4,4'-(6-methylsulfonyl-1-isoindolinyl)2,2-stilbenedisulfonate; disodium 4,4'-(7-cyano-1-isoindolinyl)2,2-stilbenedisulfonate; and disodium 4,4'-[7-(1,2,3-trihydroxypropyl)-1-isoindolinyl)]2,2-stilbenedisulfonate; disodium 4-isoindolinyl-4'-ethoxy-2,2'-stilbenedisulfonate; disodium 4-isoindolinyl-4'-methoxy-2,2'-stilbenedisulfonate; disodium 4-isoindolinyl-4'-ethoxy-2,2'-stilbenedisulfonamide; disodium 4-isoindolinyl-4'-methyl-2,2'-stilbenedisulfonamide; 4,4'-bis(4-phenyl-2H-1,2,3-triazol-2-yl)-2,2'-stilbenedisulfonic acid and mixture thereof. See also U.S. Pat. No. 3,646,015, U.S. Pat. No. 3,346,502 and U.S. Pat. No. 3,393,153 for further examples of brighteners useful herein.

Indeed one of the functionally equivalent derivative salts of 4,4'-bis(4-phenyl-2H-1,2,3-triazol-2-yl)2,2'-stilbenedisulfonic acid, namely its sodium salt is available from Mobay Chemical Corporation, a subsidiary of Bayer AG under the name Phorwite® CAN. The amine salt is available from Molay under the name Phorwite® CL solution. The potassium salt is available under the name Phorwite® BHC 766.

Other specific examples of optical brighteners useful in the present invention are those having the structural formula:

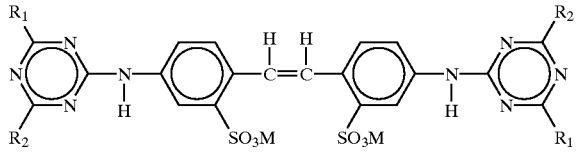

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stillbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Other substituted stilbene 2,2'-disulfonic acid derivatives also include 4-4'-bis (2-2' styryl sulfonate) biphenyl, commercially available from Ciba-Geigy under the trade name Brightener 49® or other hydrophilic brighteners like for example Brightener 3® or Brightener 47®, also commercially available from Ciba-Geigy.

Further specific examples of brighteners useful in the present invention include the polycyclic oxazole derivatives such as benzo-oxazole derivatives, or mixtures thereof and particularly preferred herein the benzo-oxazole derivatives. An example of such a brightener is benzoxazole,2,2'-(thiophenaldyl)bis having the following formula C18H10N202S, commercially available from Ciba-Geigy under the trade name Tinopal SOP®. This brightener is almost insoluble in water, i.e. it has a solubility being lower than 1 gram per liter. Another example of such a brightener is bis(sulfobenzofuranyl)biphenyl, commercially available from Ciba-Geigy under the trade name Tinopal PLC®.

Typically the compositions according to the present invention comprise up to 1.0% by weight of the total composition of a brightener or a mixture thereof, preferably from 0.005% to 0.5%, more preferably from 0.005% to 0.3% and most preferably from 0.008% to 0.1%.

Process of Bleaching Surfaces

In the present invention, the liquid bleaching composition needs to be contacted with the surface to treat.

By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

By "treating a surface", it is meant herein bleaching and/or disinfecting said surfaces as the compositions of the present invention comprise a hypohalite bleach and cleaning, i.e. removing various types of stains from the surfaces, as said compositions comprise an alkyl $(alkoxy)_{2-4}$ sulphate and optionally a co-surfactant.

Thus, the present invention also encompasses a process of treating (e.g. bleaching) a fabric, as the inanimate surface. In such a process a composition according to the present invention is contacted with the fabrics to be treated.

This can be done either in a so-called "pretreatment mode", where a liquid bleaching composition, as defined herein, is applied neat onto said fabrics before the fabrics are rinsed, or washed then rinsed, or in a "soaking mode" where a liquid bleaching composition, as defined herein, is first diluted in an aqueous bath and the fabrics are immersed and soaked in the bath, before they are rinsed, or in a "through the wash mode", where a liquid bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The processes of treating surfaces fabrics according to the present invention, especially fabrics, delivers effective whiteness performance and/or effective stain removal performance upon ageing of the compositions.

The compositions according to the present invention are preferably contacted to fabrics in a liquid form. Indeed, by "in a liquid form", it is meant herein the liquid compositions according to the present invention per se in neat or diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

More specifically, the process of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached. Accordingly, said process according to the present invention allows to bleach fabrics and optionally to wash fabrics with a detergent composition comprising at least one surface active agent before the step of contacting said fabrics with said bleaching composition and/or in the step where said fabrics are contacted with said bleaching composition and/or after the step where said fabrics are contacted with the bleaching composition and before the rinsing step and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after that said fabrics have been bleached. In the embodiment of the present invention wherein the liquid bleaching composition of the present invention, is contacted to the fabrics in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics.

It is preferred to perform the bleaching process herein before said fabrics are washed. Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described herein above (pretreater application) by a rinsing step with water and/or a conventional washing step with a liquid or powder conventional detergent, the bleaching pre-treatment operation may also be followed by the diluted bleaching process as described herein before either in bucket (hand operation) or in a washing machine.

In another embodiment the present invention also encompasses a process of treating a hard-surface, as the inanimate surface. In such a process a composition, as defined herein, is contacted with the hard-surfaces to be treated. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form typically up to 200 times their weight of water, preferably into 80 to 2 times their weight of water, and more preferably 60 to 2 times.

When used as hard surfaces bleaching/disinfecting compositions the compositions of the present invention are easy to rinse and provide good shine characteristics on the treated surfaces.

By "hard-surfaces", it is understood any hard-surfaces as mentioned herein before as well as dishes.

EXAMPLES

The invention is illustrated in the following non-limiting examples, in which all percentages are on a weight basis unless otherwise stated.

| Composition (weight %) | I | II | III | IV | V |
|---|---|---|---|---|---|
| Sodium hypochlorite | 3.50 | 3.50 | 3.00 | 3.50 | 3.50 |
| Sodium hydroxide* | 1.20 | 1.20 | 1.20 | 1.20 | 1.20 |
| Sodium carbonate | — | 3.00 | — | 3.00 | 3.00 |
| Sodium borate | — | — | 2.00 | — | — |
| Sodium silicate | — | 0.50 | 0.50 | 0.50 | 0.50 |
| Na $C_{12}/C_{14}$ E3S | 7.00 | 7.00 | 6.00 | 7.00 | 7.00 |
| m-methoxy benzoate | — | 1.0 | 0.5 | 1.0 | — |
| Ultramarine Blue (ppm) | 150 | 100 | 75 | 75 | 60 |
| Water and minor | | | up to 100% | | |
| Typical initial Viscosity** after manufacturing (cps) | 1000 | 1000 | 500 | 1000 | 460 |

| Composition (weight %) | VI | VII | VIII | IX | X |
|---|---|---|---|---|---|
| Sodium hypochlorite | 3.00 | 3.00 | 3.00 | 3.00 | 3.00 |
| 8odium hydroxide* | 1.20 | 1.20 | 1.20 | 1.20 | 1.20 |
| Sodium silicate | 0.50 | 0.50 | 0.50 | 0.50 | 0.50 |
| Na $C_{12}/C_{14}$ E3S | 6.00 | 6.00 | 7.00 | 6.00 | 6.00 |
| Na $C_{12}/C_{14}$ E2S | 0.5 | — | — | — | — |
| $NaC_8S$ | — | 0.10 | — | — | — |
| Betaine | — | — | 0.50 | — | — |
| Na $C_{12}/C_{14}$ E1S | — | — | — | 1.0 | — |
| m-methoxy benzoate | 0.5 | — | 0.5 | 0.5 | — |
| Ultramarine Blue (ppm) | 75 | 75 | 75 | 75 | 75 |
| Typical initial Viscosity** after manufacturing (cps) | 850 | 240 | 1200 | 50 | 820 |
| Water and minor | | | up to 100% | | |

-continued

| Composition (weight %) | XI | XII | XIII | XIV |
|---|---|---|---|---|
| Sodium hypochlorite | 3.00 | 3.00 | 3.00 | 3.00 |
| Sodium hydroxide* | 1.20 | 1.20 | 1.20 | 1.20 |
| Sodium silicate | 0.50 | 0.50 | 0.50 | 0.50 |
| Na $C_{12}/C_{14}$ E3S | 6.00 | 6.00 | 6.00 | 6.00 |
| m-methoxy benzoate | — | — | 0.5 | — |
| Benzoate | — | 0.5 | — | 0.50 |
| p-toluene sulfonate | — | — | 0.5 | 0.50 |
| Ultramarine Blue (ppm) | 100 | 100 | 100 | 100 |
| Water and minor | | up to 100% | | |
| Typical initial Viscosity** after manufacturing (cps) | 820 | 820 | 820 | 820 |

| Composition (weight %) | XV | XVI | XVII | XVIII |
|---|---|---|---|---|
| Sodium hypochlorite | 3.00 | 3.00 | 3.00 | 3.00 |
| Sodium hydroxide* | 1.20 | 1.20 | 1.20 | 1.20 |
| Sodium silicate | 0.50 | 0.50 | 0.50 | 0.50 |
| Sodium borate | 2.0 | 2.0 | — | — |
| Na $C_{12}/C_{14}$ E3S | 6.00 | 6.00 | 6.00 | 6.00 |
| m-methoxy benzoate | — | — | — | 0.5 |
| Benzoate | — | 0.5 | — | 0.5 |
| p-toluene sulfonate | — | — | 0.5 | — |
| Ultramanne Blue (ppm) | 100 | 100 | 100 | 100 |
| Water and minor | | up to 100% | | |
| Typical initial Viscosity** after manufacturing (cps) | 820 | 820 | 820 | 820 |

*added NaOH

**the viscosity of the compositions above was measured with a Carri-med CSL2-100 ® rheometer at the following viscosity parameters:angle 1°58', gap 60 $\mu$m, diameter 4.0 cm, inner 63.60 dyne*cm*$s^2$, temperature of 25° C. and a shear rate of 30 $sec^{-1}$.

Na $C_{12}$–$C_{14}$ E3S is an alkyl $C_{12/14}$ (ethoxy)3 sulphate commercially available from Rhone Poulenc and Albright & Wilson.

Na $C_{12}$–$C_{14}$ E2S is an alkyl $C_{12/14}$ (ethoxy)2 sulphate commercially available from Rhone Poulenc.

Na $C_{12-C14}$ E1S is an alkyl $C_{12/14}$ (ethoxy)1 sulphate commercially available from Rhone Poulenc.

$NaC_8S$ is sodium C8 alkyl sulphate.

Betaine is lauryl dimethyl amine betaine from Albright & Wilson.

LAS is sodium paraffin benzene sulphonate from Albright & Wilson.

All the compositions above are chemically and physically stable upon accelerated storage conditions, i.e., the compositions exemplified above do not undergo more than 25% AvCI2 loss after 5 days storage at 50° C. and do not show visually noticeable pigment settling after storage for 10 days at 50° C.

Also these compositions deliver effective stain removal performance as well as effective whiteness performance when used in a laundry application in their neat or diluted form, e.g. 200 times their weight of water, after prolonged periods of storage, e.g., after 3 months of storage at room temperature (25° C.) after their manufacturing.

These compositions also deliver effective cleaning performance when used in any household cleaning application.

What is claimed is:

1. A liquid coloured thickened bleaching composition having a viscosity of from 10 cps to 2000 cps, when measured with a Carri-med CSL2-100® rheometer, at the following viscosity parameters : angle 1°58', gap 60 $\mu$m, diameter 4.0 cm, inner 63.60 dyne*cm*$s^2$, temperature of 25° C. and a shear rate of 30 $sec^{-1}$ and comprising:

a hypohalite bleach, an alkyl $(alkoxy)_n$ sulphate, wherein n is from 2 to 4, optionally a co-surfactant, and cobalt aluminate blue pigment.

2. A composition according to claim 1, wherein said hypohalite bleach is an alkali metal sodium hypochlorite.

3. A composition according to claim 1, wherein said hypohalite bleach, based on active halide, is present in an amount of from 0.1% to 20% by weight of the total liquid composition.

4. A composition according to claim 1, wherein said alkyl $(alkoxy)_{2-4}$ sulphate is a water-soluble salt or acid of the formula:

$RO(A)_nSO_3M$, wherein

R is a substituted or unsubstituted, linear or branched $C_4$–$C_{24}$ alkyl,

A is an ethoxy or propoxy unit, n is an integer from 2 to 4, and M is H, a cation, or mixtures thereof.

5. A composition according to claim 1, wherein the alkyl $(alkoxy)_{2-4}$ sulphate is present in an amount of from 0.1 % to 20% by weight of the total composition.

6. A composition according to claim 1, wherein said pigment is present in the composition at a level of from 0.0001% to 0.5% by weight of the total composition.

7. A composition according to claim 1 which further comprises a pH buffering component.

8. A composition according to claim 7 wherein said pH buffering component is selected from the group consisting of alkali metal salts of carbonates, polycarbonates, sesquicarbonates, silicates, polysilicates, boron salt, phosphates, stannates, alluminates, and mixtures thereof.

9. A composition according to claim 7 wherein said pH buffering component or mixture thereof, is present in an amount of 0.5% to 9% by weight of the total composition.

10. A composition according to claim 1 which further comprises a stabilising agent selected from the group consisting of a radical scavenger, a chelating agent and mixtures thereof.

11. A composition according to claim 10 wherein said stabilising agent is an aromatic radical scavenger.

12. A composition according to claim 10, wherein said stabilising agent is a chelating agent.

13. A composition according to claim 10, wherein the stabilising agent is present in an amount of from 0.01% to 10% by weight of the total composition.

14. A composition according to claim 1, wherein said co-surfactant is selected from the group consisting of alkyl sulphates, alkyl aryl sulphonates, zwitterionic surfactants, cationic surfactants and mixtures thereof.

15. A composition according to claim 1, wherein said composition further comprises a strong source of alkalinity.

16. A composition according to claim 1, which has a viscosity of from 25 cps to 1500 cps.

17. A process of bleaching fabrics which comprises the steps of:

contacting said fabrics with a liquid bleaching composition according to claim 1, in its diluted or neat form, allowing said fabrics to remain in contact with said bleaching composition for a period of time sufficient to bleach said fabrics, and then rinsing said fabrics with water.

18. A process of bleaching fabrics according to claim 17 wherein the bleaching composition is diluted with water at a dilution level up to 500 times its weight.

19. A process according to claim 17 wherein said fabrics are washed with a detergent composition comprising at least one surface active agent prior to, during or after said fabrics are contacted with said bleaching composition.

20. A process of treating a hard-surface with a composition according to claim 1, wherein said process comprises the step of applying said composition to said hard-surface, or only soiled portions thereof, and optionally rinsing said hard-surface.

* * * * *